US008282534B1

(12) United States Patent
Sudeith et al.

(10) Patent No.: US 8,282,534 B1
(45) Date of Patent: Oct. 9, 2012

(54) SAFETY MAT SECUREMENT ASSEMBLY

(75) Inventors: Timothy S. Sudeith, Edina, MN (US); Lyle Helke, Marine on St. Croix, MN (US); Jeremy Mariette, Crystal, MN (US)

(73) Assignee: Everlast Climbing Industries, Inc., Mendota Heights, MN (US)

( * ) Notice: Subject to any disclaimer, the term of this patent is extended or adjusted under 35 U.S.C. 154(b) by 41 days.

(21) Appl. No.: 12/930,138

(22) Filed: Dec. 29, 2010

Related U.S. Application Data

(63) Continuation-in-part of application No. 11/061,583, filed on Feb. 18, 2005, now Pat. No. 7,862,480.

(60) Provisional application No. 60/545,543, filed on Feb. 18, 2004, provisional application No. 60/628,458, filed on Nov. 16, 2004.

(51) Int. Cl.
*A63B 21/00* (2006.01)

(52) U.S. Cl. ..... 482/37; 482/35

(58) Field of Classification Search ..... 24/600.4, 24/600.7, 600.8; 482/35, 37
See application file for complete search history.

(56) References Cited

U.S. PATENT DOCUMENTS 6,074,327 A * 6/2000 Franklin ..... 482/37
* cited by examiner

*Primary Examiner* — Jerome w Donnelly
(74) *Attorney, Agent, or Firm* — Eggink & Eggink; Anthony G. Eggink; Katrina M. Eggink

(57) ABSTRACT

A safety mat securement assembly for providing an open and a closed position for a climbing wall assembly using a safety mat. The safety mat securement assembly may utilize a plurality of security hand hold members each having latching means and a safety mat having a plurality of bottom securement members, top and side loop members. The security hand hold members may be used as hand holds on the climbing wall assembly and may have a locking structure. The hand holds may also have embedded securement structures to provide for the attachment of climbing related devices. The bottom securement members function to hold the safety mat to the bottom of a climbing wall assembly during both open and closed positions of the safety mat. The mat securement assembly is opened or unlocked by loosening the latching means, removing security mat top loop members from the hand hold, and placing the mats on the floor along the base of the climbing wall. When in closed or locked position, the security mats may contain a printed message communicating that the climbing wall is closed and climbing should not take place. A cover member may be provided to further secure the climbing wall.

20 Claims, 5 Drawing Sheets

SAFETY MAT SECUREMENT ASSEMBLY

This application is a Continuation-in-Part of Applicants' patent application having Ser. No. 11/061,583, filed on Feb. 18, 2005 now U.S. Pat. No. 7,862,480 entitled Safety Mat Securement Assembly. This application claims the benefit of U.S. Provisional Patent Application Nos. 60/545,543 and 60/628,458, filed on Feb. 18, 2004 and Nov. 16, 2004, respectively.

BACKGROUND OF THE INVENTION

The present invention relates generally to climbing wall assemblies and to safety mats that are used in connection with climbing wall environments. Particularly, this invention relates to a safety mat securing and locking assembly which is used in combination with safety mats utilized for climbing wall structures. More particularly, this invention relates to hand hold structures with latch assemblies constructed to secure safety mats against the climbing wall when the latter is not in use. More particularly, the invention relates to a hand hold structure with an embedded fastener structure which provides a multi-functional hand hold.

Artificial climbing and bouldering walls are increasingly popular and used due to the increase in physical fitness awareness generally and in the rock climbing and bouldering sports particularly. Climbing wall assemblies are being provided to introduce children into the climbing sports in a safe and educational manner. Such climbing wall assemblies, for example, are disclosed in U.S. Pat. No. 7,056,266, issued on Jun. 6, 2006, the teachings of which are fully incorporated by reference herein. Other climbing wall structures and environments are also known and for which the safety securement assembly of this invention may be utilized, for example, assembled climbing walls, indoor or outdoor, and existing wall structures such as concrete block, cinder block, paneled walls or like support structures.

In order to provide children and other climbers with a safe climbing environment, various safety features are utilized in conjunction with climbing wall assemblies. For example, safety mats may be provided on the floor areas surrounding and adjacent the climbing wall assembly so that should a climber fall, the landing area is padded or otherwise absorbent. It is therefore desirable to secure the mats to the wall structure to ensure that the proximity of the mats remains and so that the mats do not slide away from the wall area. Artificial climbing walls are often located in a gym or designated play area where children may otherwise play. Thus, there is a need for a wall covering to protect children from running into the wall surface and to limit access to the climbing wall. Further, children, particularly young children, should be supervised when using the climbing wall. Thus, there is a need for a wall covering to prevent the unauthorized use of the climbing wall, for example, when proper supervision is not available or when the climbing wall is otherwise not available for use.

Although the prior art discloses the use of a cable system, for example, to secure a mat against a portion of the climbing wall, that system has been found cumbersome to utilize. The prior art also discloses safety mat securement systems that are located above the climbing wall structure. These systems are likewise burdensome because they may be located too high to be easily reached and these prior art systems are not aesthetically pleasing.

A need exists for a safety mat securement and locking assembly for use with climbing walls that secure the mat both when in use on the floor as a safety mat and when in use as a wall covering. A further need exists for a mat securement assembly which is incorporated into a climbing wall and which is quick and easy to use. A further need exists for a securement assembly that is multi-functional so that it may be utilized for other climbing related purposes. A further need exists for a mat securement system that warns children and other climbers that the wall is temporarily closed and that climbing should not take place.

SUMMARY OF THE INVENTION

The safety mat securement assembly of the invention is constructed and arranged to provide an open or unlocked position and a closed or locked position for a safety mat used in connection with a climbing wall structure. The safety mat securement assembly comprises a plurality of security hand hold members or other locking structures that are incorporated into the climbing wall and a mat with a plurality of bottom, top and side securement members which interconnect the climbing wall and the mat. Each security hand hold member may comprise a latching means which includes a latch member and a fastening structure. The latch member preferably slides between an open position and a closed position and can be secured in either position using the fastening member. When in the open position the hand hold member may function as an operative hand hold. The fastening structure may comprise an embedded securement member and a cooperating fastening member, such as a bolt-type structure, for example, and which may have a unique head configuration which requires a cooperating wrench to loosen and tighten, i.e., a star or octagonal shaped bolt head requiring a mating operating tool. The fastening member cooperating with the embedded securement structure in the hand hold body may be utilized for securing a latch or be used for other functions, such as securing another hand hold structure or other climbing wall related element. A locking system may also be incorporated into or used in conjunction with the latching means. The security hand hold members have means for fastening to a wall structure. Likewise, other locking structures may be utilized having means for fastening to the wall structure for positioning in specified wall positions.

The hand hold member which may be used for safety mat securement purposes has structure which is also beneficial for other climbing related purposes. The multi-function hand hold structure, as discussed above, may have an aperture with an embedded securement member such as an internally threaded securement structure, for example, for receiving a mating externally threaded member which may be used to attach a climbing related device such as a hand hold, signage, a locking structure, exercise equipment, an attachment member or other climbing wall related devices.

The security mat constructed for use with the climbing wall may include a plurality of top loop members or like structures which are adapted to be looped, for example, into the security hand hold member, specifically around or beneath the latch member of the security hand hold member. The loop members or like structures may be attached to the cover of the mat which may be constructed of absorbent material such as foam, or of an air or other fluid cushioned structure. A plurality of securement members may preferably be located at the bottom end of the safety mat opposite the top loop members and function to hold the safety mat to the bottom of a wall climbing assembly during both open and closed positions of the safety mat. Loop members or like structures may also be provided to the sides of the mat structure to be used with positioned hand holds or like structures to secure the sides of the mat to the wall to discourage side entry during periods of non-use. The bottom securement members may be tabs or flaps or have like configurations and which are secured to the wall by means of fasteners or plate/fastener structures. A top wall cover member may also be provided for use with the safety mat securement assembly to cover the exposed top portion of a climbing wall when the safety mats are in locked position over the climbing wall surface.

The securing assembly of the present invention may be opened or unlocked by loosening the bolt member, for example, with its corresponding tool or wrench, removing the mat loop members from the hand hold, and placing the mats on the floor along the base of the climbing wall. The bolt member may then be tightened in its open position so that the security hand hold member may be used as a typical hand hold for wall climbing activities. The security mats preferably have a printed message on the bottom side to communicate that the climbing wall is closed and climbing should not take place when the mat is secured to the wall, for example showing a "no climbing", "wall closed" or a like informational message. The bottom of the mat may also have window members secured thereto for receiving printed informational inserts. The cooperating top cover member also preferably has a viewable printed message when in use, for example a "climbing wall closed" message.

It is an advantage of the present invention to provide a safety mat securement assembly that may be used to secure a safety mat to the base of a climbing wall assembly. It is another advantage of the present invention to secure the safety mat in an upright or storage position against the climbing wall in a manner so that a child or other climber is deterred from entry between the climbing wall and the mat. It is another advantage to provide a security system which communicates to children via a clear message that climbing is not to take place. It is yet another advantage of the present invention to provide a safety mat securement assembly that is easy to latch and unlatch so that the climbing wall is either readily accessible or in a closed state. It is a further advantage of the present invention to provide a safety mat security assembly which utilize components which can be used as a hand hold and mat for a climbing wall assembly. And it is a further advantage to provide a hand hold structure having an embedded securement member that forms a multifunctional hand hold structure.

These and other benefits of this invention will become clear from the following description by reference to the drawings.

DESCRIPTION OF THE PREFERRED EMBODIMENTS

The safety mat securement assembly of the present invention is constructed and arranged for use with climbing walls, i.e., for artificial walls, free standing, existing walls and panels attached to existing support wall structures. The safety mat securement assembly comprises security hand hold members, top and side mat loop members, and bottom mat securement members to secure a safety mat to the climbing wall assembly. The securement assembly provides two positions for a safety mat used with a climbing wall assembly, namely, on the floor or against the wall, thus making the climbing wall open or closed for use. The security hand hold members are constructed and arranged to be incorporated onto a climbing wall assembly, for example, using screws or other fasteners known in the art, and may be used as a hand hold for climbing the wall. Alternatively, other locking means may be utilized to secure the safety mat. The top and side loop members are constructed and arranged to fit into and be secured within the security hand hold members or other locking means. The bottom securement members are constructed and arranged to be fastened or secured to the bottom of a climbing wall assembly.

When the safety mat is on the floor it is preferably adjacent and attached to the bottom of the climbing wall assembly using the bottom securement members. When the safety mat is against the wall it is preferably attached to both the bottom of the climbing wall using the bottom securement members as well as to the positioned security hand hold members on the climbing wall using the top and side loop members.

Figure 1:
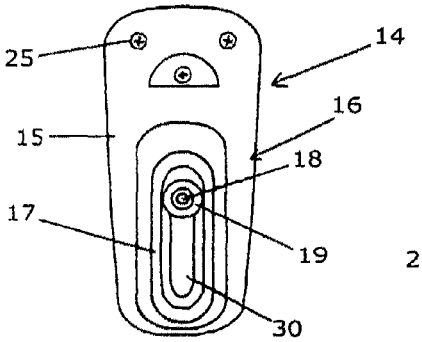
FIG. 1 is a front view of the security hand hold member of the safety mat securement assembly of the present invention.
Figure 2:
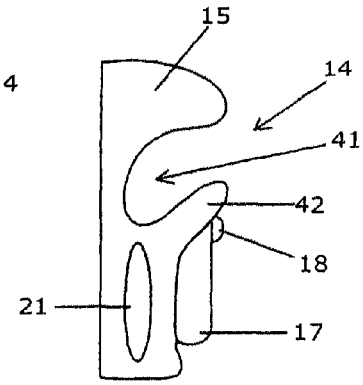
FIG. 2 is a side view of the security hand hold member of FIG. 1 and showing the hand hold member in an open position.
Figure 3:
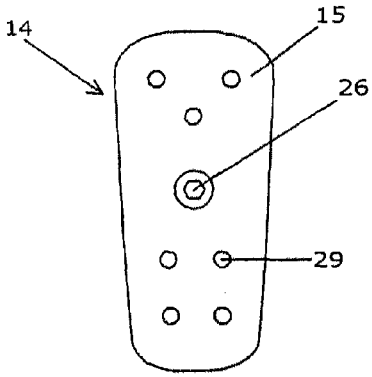
FIG. 3 is a rear view of the security hand hold member of FIG. 1.

Referring to FIGS. 1-3, security hand hold member 14 is shown comprised of body member 15 and latching means 16. Body member 15 of security hand hold member 14 is constructed and arranged having concave opening 41 and grip portion 42 thereby enabling the security hand hold member to be utilized as a hand hold when not in use for holding a mat structure against a climbing wall. Latching means 16 is shown comprised of bolt or fastening member 18, corresponding fastener 26, washer 19 and latch member 17 having slot 30. The security hand hold member 14 may be fastened to a climbing wall assembly using fasteners 25 that extend through apertures 29 of the body member 15. The security hand hold members 14 may be mounted or fastened to a climbing wall using any fastening means known in the art, for example with wood or concrete screws or other means. Logo label 21 is shown located on, i.e., molded into, the side of body member 15 to identify the manufacturer or manufacturer's mark, but may be located anywhere thereon. The hand hold members of the present invention are preferably made of a polymeric structure, i.e., a molded plastic or urethane resin.

Figure 4:
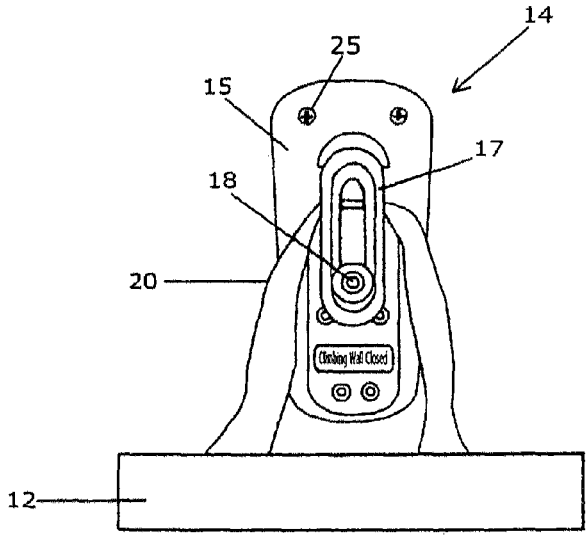
FIG. 4 is a front view of the security hand hold member in a closed position.

To engage the latching means 16 in its locking and unlocking function, bolt member 18 is loosened, latch member 17 is slid up or down along slot 30 and bolt member 18 is tightened when the latch member is in its desired position. FIG. 4 shows the latch member 17 of hand hold member 14 in a locked position and having a top loop member 20 of a mat structure 12 secured behind latch member 17.

Figure 2A:
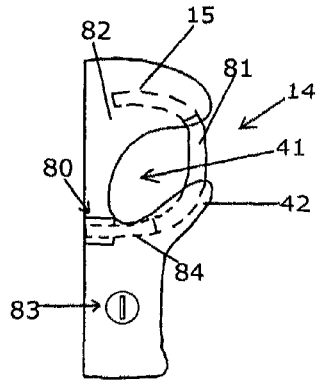
FIG. 2A is a lateral view of a hand hold showing the embedded fastener used in combination with a locking mechanism.

Alternatively, the hand hold member may incorporate a locking system. For example, a key lock or a combination lock may be incorporated into or used in conjunction with the handhold assembly. Thus, after a loop member is positioned onto a grip portion of the hand hold member and the latch member is placed in the locked position, the latch member may be locked in position via a lock key or combination lock (not shown) thereby preventing any tampering. The locking system may be incorporated into the assembly or a separate lock may be used with aligned apertures in the latch member and a portion of the hand hold member. For example, as shown in FIG. 2A, an embedded fastener 80 in aperture 84 of body member 15 is aligned with a movable clasp member 81 held in pocket 82 of the body member 15. A keyhole 83, for example, communicates with a locking mechanism which may be part of the embedded fastener structure 80. The embedded fastener structure 80 may be molded in the body member 15, held therein by an adhesive or otherwise secured in aperture 84 of the body member 15. The locking mechanism of embedded fastener 80 and the cooperating keyhole 83 may be of any configuration as known in the lock mechanism art, for example, biased locking pins which are released by a turned key.

Preferably, the safety mats of the present invention provide a shock absorbent structure for landing on when using a climbing wall. For example, in one embodiment the safety mats may be approximately two inches thick and constructed of approximately one inch cross-linked polyethylene foam laminated or bonded to approximately one inch polyurethane foam. The mats are also preferably covered with 14 oz vinyl with polyester reinforcing, for example. The mats are preferably approximately four feet wide by six feet long and have Velcro® (hook and loop) fasteners on each side so that they may be attached to additional mats in order to span an area containing a climbing wall. The visible or bottom side of the mat structure when the mat structures are secured to the hand holds preferably contains a message to communicate that climbing is not to take place, for example a "No Climbing", "Wall Closed" or like message.

The shock absorbent structure of the safety mats may also include mat structures utilizing fluid with or without combinations of foam structures, for example. Thus, air-type mattresses and like fluid filled structures using inflator valves may be used within the purview of the present invention. The fluid filled structures may also incorporate other absorbing materials, such as foam, within its enclosure structure.

Figure 5A:
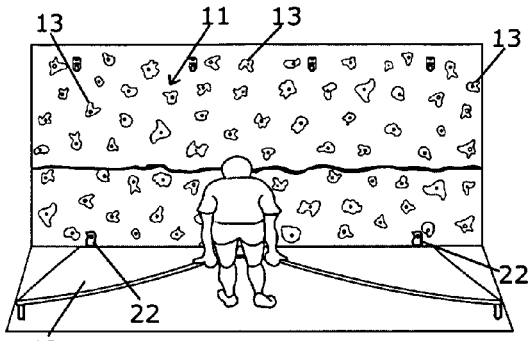
FIG. 5*a* shows a climbing wall assembly having a safety mat assembly being lifted from a usable position to a secured closed position.
Figure 5B:
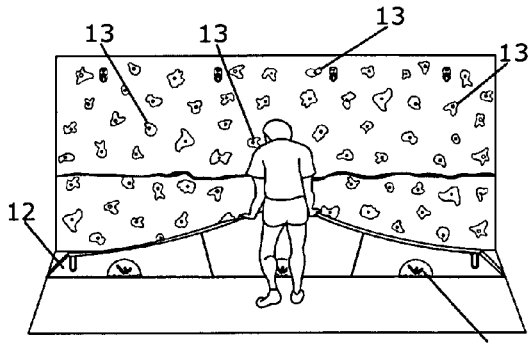
FIG. 5*b* shows a climbing wall assembly having a safety mat assembly being lifted from a usable position to a secured closed position.
Figure 5C:
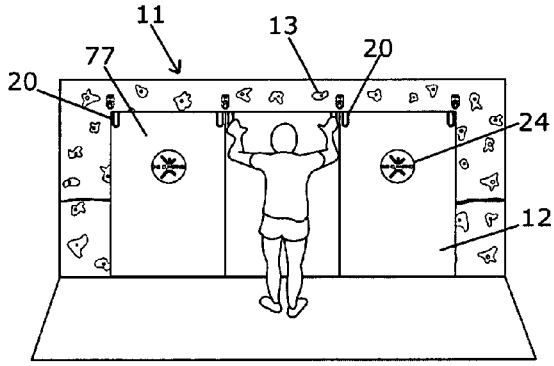
FIG. 5*c* shows a climbing wall assembly having a safety mat assembly being lifted from a usable position to a secured closed position.

FIGS. 5*a*-5*c* show the sequence of a climbing wall assembly 11 having a safety mat assembly 12 being lifted from open position to closed position. Climbing wall assembly 11 is shown having hand holds 13 and a safety mat structure 12. FIG. 5*a* shows the mat structure 12 being initially lifted off the ground. Bottom securement members 22 are shown. FIG. 5*b* shows the mat structure being further lifted and FIG. 5*c* shows the mat structure 12 in position against the climbing wall assembly 11. Warning message 24, i.e. "No Climbing" or "Wall Closed", is shown on the underside of the mat structure 12 to inform users that the wall is closed. A warning message may be applied to a mat structure via a silk screen printing process or another like process.

Figure 6A:
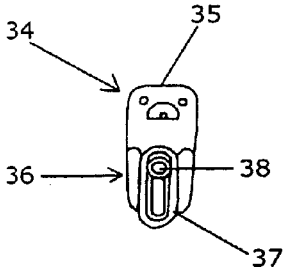
FIG. 6*a* shows a security hand hold member in the open position.
Figure 6B:
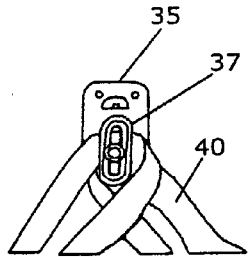
FIG. 6*b* shows the latch member of a security hand hold member being slid to a closed position.
Figure 6C:
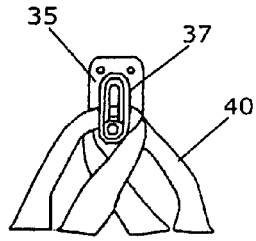
FIG. 6*c* shows a security hand hold member in locked position and securing a pair of loop members.

FIGS. 6*a*-*c* show an alternate embodiment 34 of the hand hold member, which locks and unlocks in a similar manner to the embodiment described with respect to FIGS. 1-4. Hand hold embodiment 34 is shown having body member 35 and a latching means 36 comprising latch member 37 and bolt member 38. FIG. 6*a* shows the latch member 37 in an open position. FIG. 6*b* shows two top loop members 40 from a mat structure secured behind the latch member 37 which is being slid upwards into the locked position. FIG. 6*c* shows the latch member 37 in a closed position, holding the top loop members 40 in place, and thus effectively closing a climbing wall assembly by securing the mat to the front of the climbing wall.

Figure 7:
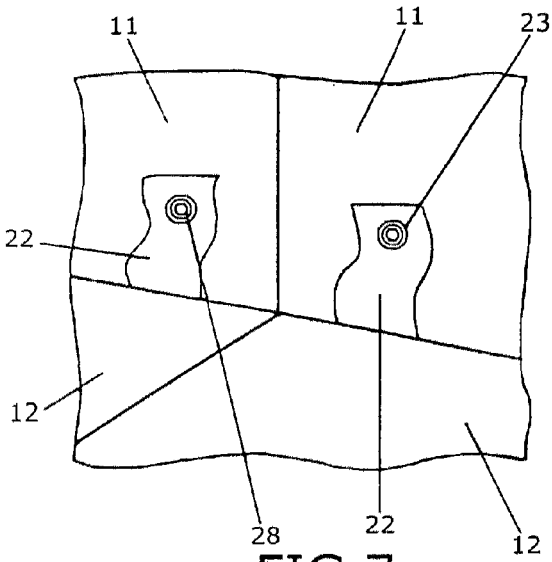
FIG. 7 is a perspective view of a bottom securement member of the safety mat securement assembly of the present invention.
Figure 9:
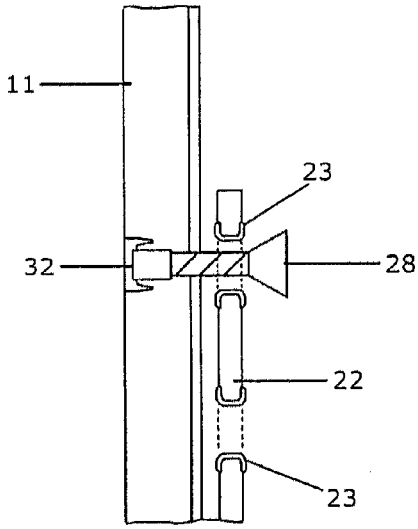
FIG. 9 is a cross-sectional view of a bottom securement member of the present invention.
Figure 10:
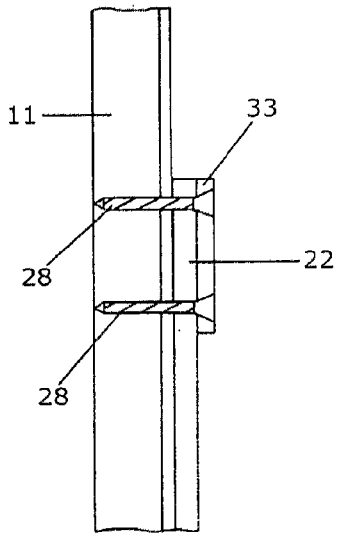
FIG. 10 is a cross-sectional view of an alternate embodiment of the bottom securement member.

FIG. 7 shows mat structure 12 having bottom securement member tabs 22 utilizing grommet 23 for attachment of the mat structure to a wall or climbing assembly 11, using fastener 28, for example a flat head cap screw. FIG. 9 is a cross-sectional view of an alternate embodiment of the bottom securement member 22 being attached to the climbing wall 11 using cooperating fastening components 28 and 32 and grommet 23. A second grommet 23 is shown disposed on bottom securement member 22 to further secure member 22 using cooperating fastening components 28 and 32. Fastener 32 may be a t-nut, for example and is used in conjunction with fastener or screw 28 to form a fastening structure to hold the bottom securement member 22 to a paneled climbing wall 11. Any means known in the art may be used to attach the bottom securement members to a climbing wall including, for example, plates made of wood, plastic, metal or another like material may be utilized to secure the securement members to a wall. FIG. 10 shows plate member 33 utilized to secure the bottom securement member 22 to climbing wall assembly 11 via fasteners 28. The plate member 33 may have the width of the securement tab 22 and which maintains the integrity of the tab structure (webbing stitched or fastened to the mat body) during use.

Figure 8:
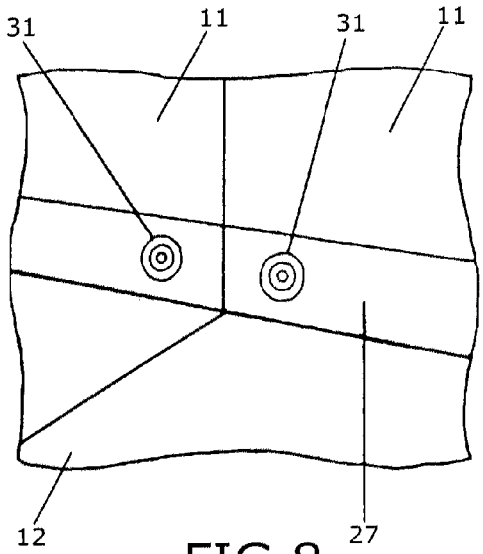
FIG. 8 is an alternate embodiment of the bottom securement member.

Preferably, each mat structure has a plurality, i.e., two top loop members securely attached to the top of the mat and two bottom securement member tabs attached to the bottom, although other numbers of top loop members and configurations of bottom securement members are within the purview of this invention. As further discussed below, side loops may also be utilized to secure the mat structure to the climbing wall. FIG. 8 shows an alternate embodiment 27 of a bottom securement member in a flap form. Bottom securement member flap 27 is shown having grommets 31 and attached to mat structure 12. Bottom flaps 27 may be provided in various sizes to accommodate various climbing wall configurations, for example 4 inch and 12 inch wide flaps. The top loop members and bottom securement members may be sewn to the safety mat or attached using other fastening means known in the art. The top loop members are preferably constructed of webbing, vinyl or like material, for example, seatbelt material. The bottom securement tabs are preferably also constructed of webbing or a like material.

Figure 11:
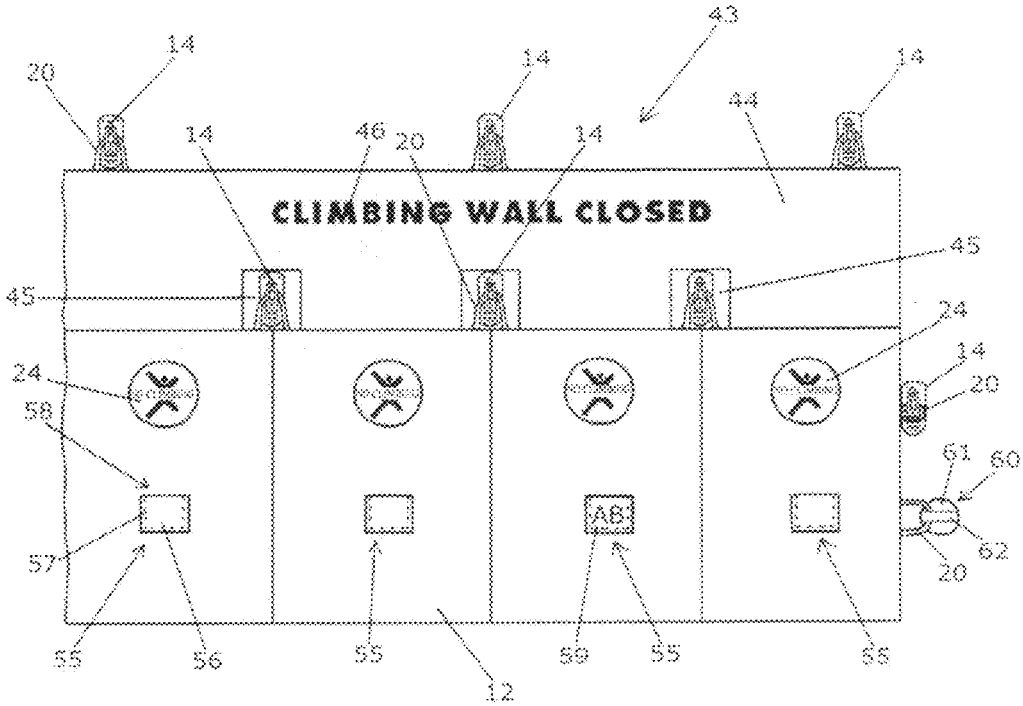
FIG. 11 is a frontal view showing the safety mat securement assembly of the present invention in the closed position and in use with a top cover member.

FIG. 11 shows safety mat structure 12 in an upright/locked position against climbing wall assembly 11. Top cover member 43 is provided and shown in use with the safety mat securement assembly of the present invention. Top cover member 43 is provided to enable the exposed climbing wall portion to be covered and locked, for example, by spanning the exposed climbing wall above the safety mats. For example, if the climbing wall is ten feet high and the safety mats are six feet tall, then four feet of the climbing wall would remain exposed above the safety mats when in a locked position. The top cover member of the present invention may be a reinforced fabric, a plastic coated fabric, or a polymeric flexible material, i.e., made of "vinyl", a plasticized polyvinylchloride or a like material and can be constructed of various lengths and widths, for example, to cover various sizes of climbing walls. The top cover member preferably adds security to the safety mat securement assembly of the present invention as well as providing a system that is light in weight, affordable and easy for one person to maneuver.

The top cover member 43 may be held in place, above or on the top portion of the climbing wall assembly, for example using Velcro® (hook and loop fastener system), specially designed hand holds, pulleys, grommets, hooks, other securement structures and combinations thereof. FIG. 11 shows top cover member 43 having elongated flexible body 44 being held in place by loops 20 within cooperating security hand hold members 14 which are shown mounted on the wall above the climbing wall. When securing a climbing wall using the top cover member 43, the flexible body 44 of the top cover 43 is first spread along the exposed wall portion of the climbing wall and securing the loops to the hand hold members 14 shown above the climbing wall. For example, flexible body 44 is shown to have apertures 45 which expose security hand hold members 14 which are mounted on the climbing wall and which are used to secure safety mat 12 as discussed above. Thus, when the security hand hold members 14 are in the locked position, the apertures function to hold the top cover member in place. Informational or warning message 24 is shown printed on the surface of safety mat 12. Further enlarged warning message 46, "CLIMBING WALL CLOSED", is shown disposed on the top portion of top cover member 43. The warning messages may be affixed to the safety mat and the top cover member via a silk screen printing process or other printing means.

It is also within the purview of this invention to secure a mat that does not utilize bottom securement tabs or top loop members. For example, a webbed envelope structure having bottom securement tabs and top loop members as described above may receive a mat for use with the security hand hold members of the present invention.

As further shown in FIG. 11, the securement mat 12 is shown to have window structures 55 secured thereto. The window structures 55 are shown to have a clear plastic member 56 which is affixed to the mat 12 by means of peripheral fastening means 57, i.e., stitching, adhesive or the like. The window member 55 has a clear plastic member 56 with an open upper side 58. An insert 59 is shown in one of the window members 55. Further, loop members 20 are shown secured to the side of the mat 12, and used in conjunction with security hand hold members 14. The lateral securement prevents children from climbing or entering behind the mat 12 when it is secured to the climbing wall. Further, locking member 60 is shown positioned to the side of the climbing wall and having body 61 and latch 62. The locking member 60, for example, may not be a hand hold and may be constructed and arranged to only secure a mat loop member 20. The locking member 60 may have a loop holding and securing portion with a lock, i.e., requiring a key or combination or may comprise a lock itself which is secured to the wall.

Figure 12:
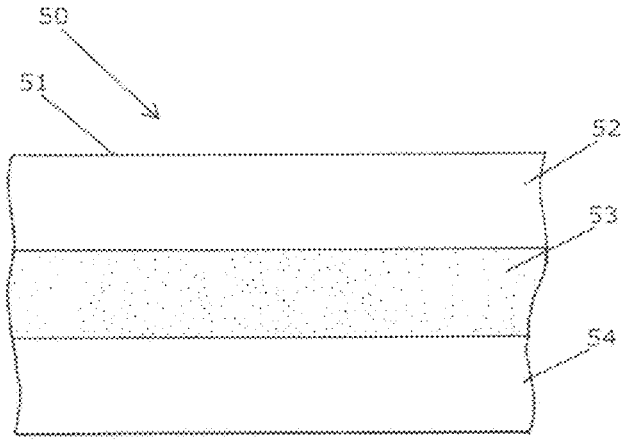
FIG. 12 is a sectional view of a safety mat structure for use in climbing wall environments.

FIG. 12 shows mat structure 50 having a generally planar body 51 comprised of first layer 52, second layer 53 and third layer 54. Layer 53 is preferably constructed of polyurethane foam and layers 52 and 54 are preferably constructed of a cross-linked polyethylene foam. The three layers may be laminated or otherwise secured into a unitary structure. Each layer is preferably approximately one inch thick. Thus, each mat structure 50 has an approximately three inch total thickness and is preferably covered with 14 ounce vinyl with polyester reinforcing. The mats are preferably four by six square feet in area and include a fastener, such as Velcro® (hook and loop) on at least two sides for attachment to other mats and to the base of a climbing wall when in an unlocked or open position. The underside of each mat preferably contains a warning or informational label that is visible when the mat is in a closed or locked position indicating that no climbing may take place.

Figure 13:
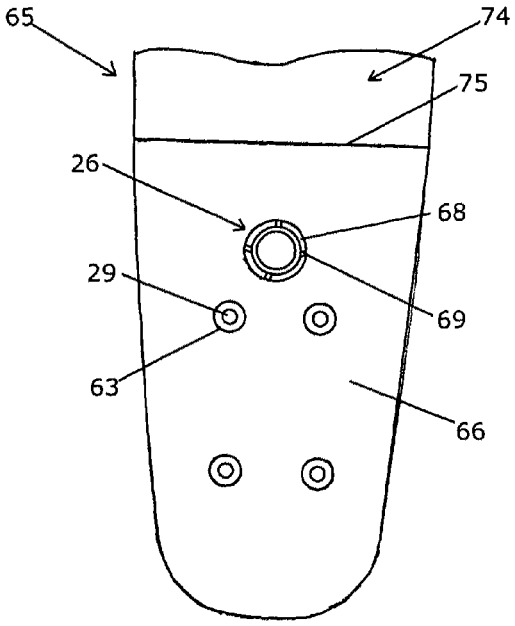
FIG. 13 is a frontal plan view of a hand hold assembly of the present invention.
Figure 14:
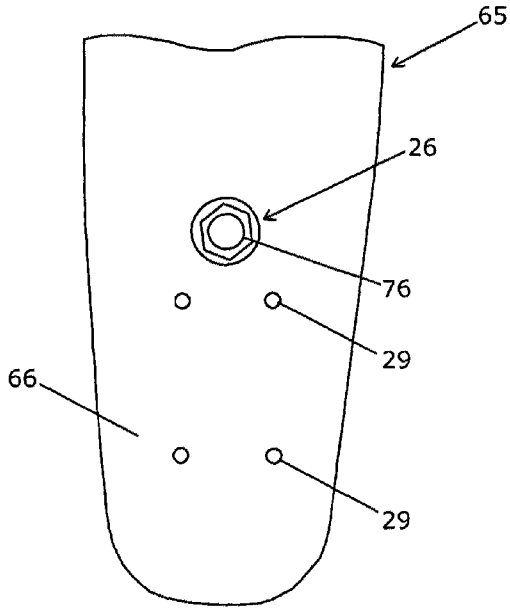
FIG. 14 is a rear plan view of the hand hold assembly of FIG. 13.
Figure 15:
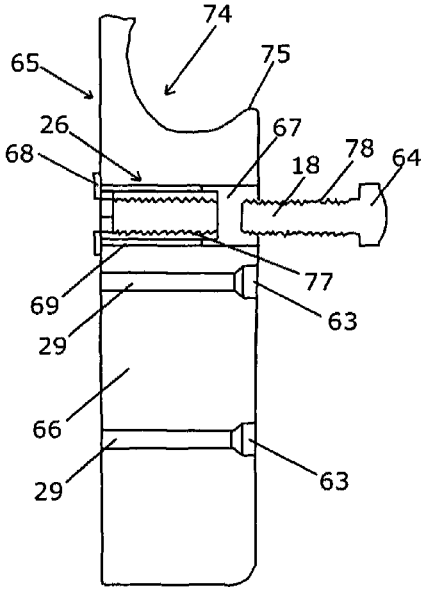
FIG. 15 is a lateral sectional view of the hand hold assembly of FIG. 13 and further showing a threaded bolt for insertion into the embedded fastener insert.

Referring to FIGS. 13, 14 and 15, a hand hold assembly 65 is shown having a formed body member 66 and which may have a concave opening 74 and a grip portion 75 similar to the security hand hold member 14 shown in FIGS. 1-4. However, the hand hold assembly 65 is a multifunctional hand hold which has a structure adapted to permit the attachment of a variety of climbing related elements to its body member 66 by means of an embedded securement structure and a cooperating fastening member.

As further shown in FIGS. 13-14, the body member 66 of hand hold 65 has a plurality of apertures 29 which permit screws, for example, to extend therethrough for mounting the hand hold 65 to a climbing wall structure. The apertures 29 may be countersunk as shown in FIGS. 13 and 15 so that screws 25 as shown in FIGS. 1 and 4 may be mounted flush with the exterior surface of the hand hold body. A relatively larger aperture 67 is shown in FIG. 15 extending through body member 66 and having a securement insert 26 embedded into the body member 66. The insert 26 is shown having an outer periphery 68 larger than the diameter of aperture 67 and a formed hexagonal end, for example, which may be used to screw the insert 26 by means of external threads 69 into the formed bore of aperture 67. As a result, the insert 26 having internal threads 77 is securely embedded into the hand hold 65 and may receive a cooperating externally threaded fastening member 18, for example, to secure a climbing related element, such as another hand hold, a latch, or any element having an aperture to receive a bolt member 18, for example, to thereby secure the element to the hand hold body 66. The length of the fastening member 18, such as the length of a bolt having threads 78 to match the internal threads 77 of insert 26, may be varied as well as the diameter of the bolt head 64 to accommodate the climbing related element which is attached to the body member 66 of hand hold 65.

The front bottom surface of the body member 66 is shown to have a generally flat configuration similar to the rear surface of the body member 66 so as to permit the attachment of elements to the body member similar to that of attaching the hand hold 65 to the surface of a generally flat climbing wall surface. Although shown to be generally flat, other matching or cooperating surface configurations may be utilized within the purview of the invention. As is evident, should a fastening member not be inserted or be fully inserted into the embedded securement member 26, the hand hold 65 may be utilized by a climber as any other hand hold structure.

Figure 15A:
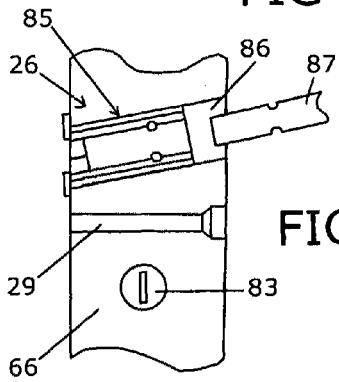
FIG. 15A is a lateral sectional view showing the hand hold assembly having the embedded fastener used in combination with a lockable end element.

As shown in FIG. 15A, an embedded fastener 85 is shown positioned at an angle in body member 66. Thus, an element end 87 may be rotated from a pocket in the hand hold body, as described above with respect to FIG. 2A, may be aligned with the embedded fastener 85 for mating or connecting for locking purposes. For example, the clasp end of a lock or the end of a climbing related element 87 may be rotated or otherwise moved from a stored position in the hold body (as shown in FIG. 2A) or moved from a remote location as shown with respect to the bolt members of FIGS. 1, 2 and 15 for locking in embedded fastener 85. The embedded fastener 85 may therefore be positioned in the handhold body 66 at any desired angle to cooperate with an end piece of a climbing wall related element.

Figure 16:
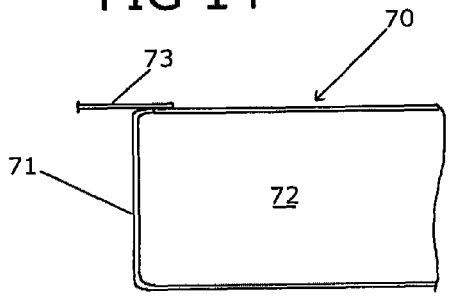
FIG. 16 is a sectional view of a safety mat structure for use with a climbing wall.

Referring to FIG. 16, a safety mat 70 is shown having an exterior cover 71 and a fastening member 73 extending therefrom. The safety mat 70 shown has a fluid 72 such as air, to absorb any forces from a climber. Although foam fitted mat structures, such as cross-linked polyethylene and polyurethane foams are described above, it is within the purview of the invention to use air filled mats for climbing wall related activities. The fluid or air filled mat 70 may have baffles or other supporting members within the exterior cover 71 to cooperate with the air 72 for absorbing forces. The fastening member 73 may be a loop or other member extending from the mat 70 so as to be cooperatively used with the safety securement assemblies set forth above.

As many changes are possible to the safety mat securement assembly of this invention, utilizing the teachings thereof, the description above and the accompanying drawings should be interpreted in the illustrative and not the limited sense.

What is claimed is:

1. A hand hold assembly for mounting to a climbing wall comprising:

a) a rigid body member having a rear surface for engaging the climbing wall, said rigid body member having a top portion, a bottom portion and an indented cavity between said top and bottom portions, said indented cavity forming a handgrip surface having an upwardly extending portion;

b) a securement member embedded in said rigid body member, said securement member constructed to receive a cooperating fastening member for holding a climbing wall related element; and c) means to mount said formed rigid body member to a climbing wall, said securement member comprising an internally threaded member embedded in said rigid body member and said cooperating fastening member comprising a bolt member.

2. The hand hold assembly of claim 1, wherein said assembly has a slidable latch member having a top portion, said latch member for movable extension between said top and bottom portions of said rigid body member, said slidable latch member being aligned with said embedded securement member, said securement member and said fastening member constructed to lock said slidable latch member with respect to said indented cavity of said rigid body member.

3. The hand hold assembly of claim 2, wherein said top and bottom portions of said rigid body member have aligned slots for receiving said slidable latch member and wherein said aligned slots of said top and bottom portions have generally flat surfaces on which said slidable latch member moves.

4. The lockable hand hold assembly of claim 3, wherein said slot of said top portion of said rigid body member has an upwardly disposed curved portion and wherein said slot of said bottom portion of said rigid body member has a downwardly disposed curved portion and wherein said slidable latch member has a centrally disposed opening for receiving said cooperating fastening member.

5. The hand hold assembly of claim 1, wherein said securement member is constructed to hold a securement element of a mat structure having a compressible foam or a fluid interior structure.

6. The hand hold assembly of claim 1, wherein said rigid body member and said slidable latch member are formed of a polymeric material and wherein said means to mount said formed rigid body member is comprised of a plurality of apertures therethrough.

7. The hand hold assembly of claim 1, wherein said securement member is constructed and arranged as a locking mechanism to receive the end of a clasp or the end of a climbing related element.

8. A hand hold assembly for mounting to a climbing wall comprising:

a) a formed, rigid body member having a rear mounting surface and a generally curved exterior frontal surface extending therefrom, said curved exterior of said formed body member including a curved cavity, said formed rigid body member having an outwardly extending gripping member with spaced upwardly extending grip portions and a slidable latch member constructed to slide over said curved cavity from a locked position to an unlocked position, said slidable latch member being constructed to slide between said spaced upwardly extending grip portions of said gripping member;

b) a securement member comprising an embedded securement member in said formed rigid body member and a cooperating fastening member; and c) means to mount said formed, rigid body member to a climbing wall.

9. The hand hold assembly of claim 8, wherein said embedded securement member is internally threaded and wherein said cooperating fastening member is a threaded bolt member and wherein said slidable latch member is an elongated structure having an elongated aperture therethrough and wherein said bolt member extends through said elongated aperture.

10. The hand hold assembly of claim 9, wherein said body member and said latch member are constructed of a polymeric composition and wherein said means to mount is comprised of a plurality of apertures through said formed, rigid body member for receiving fasteners to secure said hand hold assembly to a climbing wall.

11. A lockable hand hold assembly for a climbing wall comprising:

a) a rigid body member having a rear surface for engaging the climbing wall, said rigid body member having a top portion, a bottom portion and an indented cavity between said top and bottom portions, said indented cavity forming a handgrip surface having an upwardly extending portion;

b) means to mount said rigid body member to a climbing wall;

c) a slidable latch member having a top portion, said latch member for movable extension between said top and bottom portions of said rigid body member; and d) a securement member embedded in said rigid body member, said securement member constructed to lock said slidable latch member with respect to said indented cavity of said rigid body member.

12. The lockable hand hold assembly of claim 11, wherein said securement member comprises an internally threaded member embedded in said rigid body member aligned with said slidable latch member and a cooperating bolt member.

13. The lockable hand hold assembly of claim 12, wherein said top and bottom portions of said rigid body member have aligned slots for receiving said slidable latch member and wherein said aligned slots of said top and bottom portions have generally flat surfaces on which said slidable latch member moves.

14. The lockable hand hold assembly of claim 12, wherein said securement member is constructed to hold a securement element of a mat structure having a compressible foam or a fluid interior structure.

15. The lockable hand hold assembly of claim 14, wherein said slot of said top portion of said rigid body member has an upwardly disposed curved portion and wherein said slot of said bottom portion of said rigid body member has a downwardly disposed curved portion.

16. The lockable hand hold assembly of claim 12, wherein said slidable latch member has a centrally disposed opening for receiving said cooperating bolt member.

17. The lockable hand hold assembly of claim 12, wherein said rigid body member and said slidable latch member are formed of a polymeric material.

18. The lockable hand hold assembly of claim 12, wherein said rear surface of said rigid body member is a generally flat surface and wherein said means to mount said rigid body member comprises a plurality of apertures therethrough.

19. The hand hold assembly of claim 8, wherein said securement member further includes a key hole and cooperating locking mechanism and wherein said slidable latch member is a movable clasp member extendable from said rigid body member.

20. The lockable hand hold assembly of claim 12, wherein said slidable latch member is slidable from within said rigid body member.

* * * * *